US011766886B2

(12) United States Patent
Beaucher

(10) Patent No.: US 11,766,886 B2
(45) **Date of Patent: *Sep. 26, 2023**

(54) WRITING INSTRUMENT

(71) Applicant: SOCIÉTÉ BIC, Clichy (FR)

(72) Inventor: Laurent Beaucher, Clichy (FR)

(73) Assignee: SOCIÉTÉ BIC, Clichy (FR)

( * ) Notice: Subject to any disclaimer, the term of this patent is extended or adjusted under 35 U.S.C. 154(b) by 0 days.

This patent is subject to a terminal disclaimer.

(21) Appl. No.: 17/459,293

(22) Filed: Aug. 27, 2021

(65) Prior Publication Data

US 2022/0063322 A1 Mar. 3, 2022

(30) Foreign Application Priority Data

Aug. 27, 2020 (EP) ..... 20305954

(51) Int. Cl.

| | |
|---|---|
| ***B43K 29/02*** | (2006.01) |
| ***B43K 7/00*** | (2006.01) |
| ***B43K 8/00*** | (2006.01) |
| ***B43K 8/02*** | (2006.01) |

(52) U.S. Cl.

CPC ..... *B43K 29/02* (2013.01); *B43K 7/005* (2013.01); *B43K 8/003* (2013.01); *B43K 8/024* (2013.01)

(58) Field of Classification Search

CPC ..... B43L 19/00; B43L 19/0081; B43K 29/05; B43K 29/02

See application file for complete search history.

(56) References Cited

U.S. PATENT DOCUMENTS

| | | | | |
|---|---|---|---|---|
| 1,473,090 A | | 11/1923 | Ferry | |
| 2,069,462 A | * | 2/1937 | Rouse | B43K 29/02 401/62 |
| 2,587,380 A | | 2/1952 | Polynice | |
| 2,637,900 A | | 5/1953 | Thompson | |
| 2,815,002 A | * | 12/1957 | Mayes | B43K 29/02 401/99 |

(Continued)

FOREIGN PATENT DOCUMENTS

| | | |
|---|---|---|
| EP | 0556668 B1 | 11/1995 |
| EP | 2977416 B1 | 7/2016 |

(Continued)

OTHER PUBLICATIONS

Extended European Search Report dated Jan. 21, 2021 in European Patent Application No. 20305954.8 (8 pages).

(Continued)

*Primary Examiner* — Patrick M. Buechner

(74) *Attorney, Agent, or Firm* — Bookoff McAndrews, PLLC

(57) ABSTRACT

A thermochromic ink writing instrument comprising a body extending along an axis, the body having a first end and a second end opposed to the first end along the axis, the first end being provided with a writing tip and with an eraser, wherein the writing tip is fed with thermochromic ink, wherein the writing tip is fixed with regard to the body and the eraser is movable along the axis with regard to the body, and the thermochromic ink writing instrument further comprising a helical-cam propelling mechanism configured to move the eraser along the axis between a retracted position and a protruding position.

20 Claims, 4 Drawing Sheets

(56) References Cited

U.S. PATENT DOCUMENTS

| | | | | |
|---|---|---|---|---|
| 5,127,130 | A * | 7/1992 | Copito | B43K 29/02 15/431 |
| 5,389,717 | A | 2/1995 | Santini et al. | |
| 5,413,428 | A * | 5/1995 | Kageyama | B43K 25/028 401/110 |
| 5,855,442 | A | 1/1999 | Keller | |
| 6,979,142 | B1 * | 12/2005 | Chmelar | B43K 29/02 401/65 |
| 9,409,438 | B2 | 8/2016 | Ohtsuka | |
| 10,315,833 | B2 | 6/2019 | Erdmann et al. | |
| 2005/0234150 | A1 | 10/2005 | Omatsu et al. | |
| 2006/0069183 | A1 | 3/2006 | Kurihara et al. | |
| 2006/0153626 | A1 * | 7/2006 | Mook | B43L 19/0068 401/23 |
| 2022/0063323 | A1 * | 3/2022 | Beaucher | B43K 7/005 |

FOREIGN PATENT DOCUMENTS

| | | | |
|---|---|---|---|
| JP | S6360104 | A | 3/1988 |
| JP | 05279614 | A | 10/1993 |
| JP | 2002-265843 | A | 9/2002 |
| JP | 2003-221542 | A | 8/2003 |
| JP | 2004143213 | A | 5/2004 |
| JP | 2004143381 | A | 5/2004 |
| JP | 2009-184279 | A | 8/2009 |
| JP | 2011-230439 | A | 11/2011 |
| WO | 94/10251 | A1 | 5/1994 |
| WO | 2005/120862 | A2 | 12/2005 |

OTHER PUBLICATIONS

Extended European Search Report dated Mar. 29, 2021 in European Patent Application No. 20306280.7 (5 pages).

"BIC DUO Ball Pen / Highlighter, Refillable, Black, 6 Pen/Highlighters" Amazon Listing, http://web.archive.org/web/20210826202048/https://www.amazon.com/BIC-Highlighter-Refillable-Black-Highlighters/dp/B000F2PEA4/ref=cm_cr_arp_d_product_top (archived Aug. 26, 2021).

Google Patents entry for JP3027484B2 <https://patents.google.com/patent/JP3027484B2/en?oq=JP3027484B2> (retrieved Aug. 27, 2021).

Search Report issued in corresponding European Application No. 20 16 7377, dated Aug. 25, 2020.

Search Report issued in corresponding International Application No. PCT/EP2021/058050, dated Jun. 28, 2021.

* cited by examiner

WRITING INSTRUMENT

This application claims priority from European patent application No. 20305954.8, filed Aug. 27, 2020, its content being incorporated herein by reference.

TECHNICAL FIELD

The present disclosure relates to an erasable ink writing instrument provided with an eraser disposed at the front end.

TECHNICAL BACKGROUND

Traditional retractable erasable ink writing instrument are usually provided with an eraser disposed at the rear end, onto the button for actuating the writing tip. However, when the button is actuated in order to project/retract the writing tip, the user contacts the eraser with his fingers/thumb and makes it dirty. A solution consists in providing a protective cap for the eraser. However, such an additional cap has a negative impact on the manufacturing costs while it is often lost by the user. Another solution is to place the eraser at another place on the writing instrument. However, the resulting structure is usually complex and presents a relatively big size which is not user-friendly. Therefore a need exists to provide a user-friendly erasable ink instrument having an eraser which is prevented from being touched by the user and a writing tip which may be easily protected when not used.

SUMMARY

In embodiments, an erasable ink writing instrument comprises a body extending along an axis, the body having a first end and a second end opposed to the first end along the axis, the first end being provided with a writing tip and with an eraser, wherein the writing tip is fed with erasable ink, wherein the writing tip is fixed with regard to the body and the eraser is movable along the axis with regard to the body, and the erasable ink writing instrument further comprises a helical-cam propelling mechanism configured to move the eraser along the axis between a retracted position and a protruding position.

The first end is the front end and the second end is the rear end. The writing tip may be a felt tip, a ballpoint tip or any other element making it possible to write on a substrate or surface with an erasable ink. In the following, and unless otherwise specified, "writing instrument" should be understood as "erasable ink writing instrument".

The eraser can axially move with regard to the body and the writing tip cannot move (in normal use) with regard to the body.

In the protruding position the eraser may be able to be used for erasing while the writing tip may be not able to used for writing. In the retracted position the eraser may be not able to be used for erasing while the writing tip may be able to be used for writing. For example, in the protruding position, the eraser may protect the writing tip.

The eraser disposed on the first end and actuated by a helical-cam propelling mechanism may prevent the user from touching the eraser. The helical-cam propelling mechanism may permit to obtain a relatively simple structure and the writing instrument may have a relatively small size and may be ergonomic/easy to use. The retractable eraser disposed on the first end may provide the same effect as a retractable writing tip: the writing tip may be protected when not used and available for use by a simple actuation of an element of the writing instrument.

In embodiments, the eraser and the writing tip may be coaxial, the eraser being disposed around the writing tip, the writing tip comprising a writing end, and, when the erasable ink writing instrument is seen perpendicular to the axis, the writing end is concealed by the eraser when the eraser is in the protruding position and the writing end is free from the eraser when the eraser is in the retracted position.

The writing end is the portion of the writing tip which is applied on a substrate or surface for writing.

The eraser may form a sleeve around the writing tip and sliding along the axis in order to free the writing end for writing (i.e. in the retracted position) or to concealed the writing end for its protection when not used (in the protruding position). The eraser may have a tube shape.

In embodiments, the eraser may have a distal end, and the distal end may have a frustoconical shape.

In embodiments, the helical-cam propelling mechanism may comprise a first part having one of a helical cam and a cam follower and a second part having the other of the helical cam and the cam follower, and the first part is axially coupled in at least one direction with the eraser and the second part is fixed to the second end, inside the body.

In other words, the first part may have the helical cam and the second part the cam follower or the first part may have the cam follower and the second part the helical cam. The second part may not be able to move with regard to the second end. The first part may be axially coupled with the eraser in only one axial direction or in the two opposite axial directions. In other words, the eraser may move along the axis together with the first part in only one direction or in the two opposite directions.

The helical-cam propelling mechanisms as such are well known for the skilled person and are not disclosed in detail. For example, the helical cam may have any shape, any pitch, any angular stroke, etc.

In embodiments, the second part may be snap-fitted with the second end.

The second part may be removably or un-removably snap fitted with the second end.

In embodiments, the body may comprise a first portion having the first end and a second portion having the second end, the first portion and the second portion are rotatable relative to each other, and the first part is rotatably coupled with the first portion and axially movable with regard to the first portion.

The first part may turn around the axis together with the first portion and may remain free to move along the axis with regard to the first portion.

The relative rotation of the first portion with regard to the second portion may actuate the helical-cam propelling mechanism, due to which the eraser may be moved between the retracted position and the protruding position.

In embodiments, the first portion may be rotatably snap-fitted with the second portion.

In embodiments, the first part may comprise one of at least one axial projection and at least one axial recess, the first portion comprises the other of the at least one axial projection and the at least one axial recess, and the at least one axial projection and the at least one axial recess are slidably engaged with each other axially.

In other words, the first part may comprise the at least one axial projection and the eraser the at least one axial recess or the first part may comprise the at least one axial recess and the eraser the at least one axial projection. The number of axial projection(s) may be the same as the number of axial recess(es). Each axial projection may be engaged with an axial recess.

In embodiments, the erasable ink writing instrument may comprise a writing body having the writing tip, wherein the first part is hollow, a support extends inside the first part and is axially coupled with the second part, and the support supports the writing body.

The support may be not able to move along the axis with regard to the second part. The support may be snap-fitted or press-fitted to the second part. The support may be fixed or removable with regard to the second part.

For example, the writing body may be a cartridge.

In embodiments, the writing body may be removably mounted to the support.

In embodiments, the writing body may be press-fitted to the support.

In embodiments, the support and the second part may be unitarily/monolithically formed.

In other words, the support and the second part may form together a same and single piece.

In embodiments, the erasable ink writing instrument may comprise a writing body having the writing tip, wherein the eraser is mounted onto a tube holder, the eraser is axially coupled in at least one direction with the first part via the tube holder, and the writing body extends at least in part into the tube holder in any position of the eraser.

The eraser may be mounted onto an axial end of the tube holder, for example by snap-fitting or press-fitting, and the other axial end of the tube holder may be coupled in only one axial direction or in the two opposite axial directions with the first part. In a variant, the eraser may be mounted onto the axial end of the tube holder by being overmolded onto the axial end of the tube holder.

In embodiments, the erasable ink writing instrument may comprise a return spring configured to axially push the eraser toward the first part.

For example, the return spring may be a coil spring which works in compression.

In embodiments, the return spring may be configured to axially push the eraser from the extended position toward the retracted position while the eraser abuts against the first part axially.

In such a case, the eraser is coupled with the first part in only one axial direction. In embodiments, the tube holder may also be coupled with the first part in only one axial direction (i.e. the eraser is coupled with the first part in only one axial direction via the tube holder).

In embodiments, the erasable ink writing instrument may comprise a writing body having the writing tip, wherein the body comprises a nose cone, the nose cone comprises the first end, and the nose cone is removable, due to which the writing body is removable for refill.

For example the nose cone is screwed with the body. For example, the nose cone is screwed with the first portion.

In embodiments, the eraser is a friction body.

A peelable ink is an ink that forms a removable layer on the substrate or surface onto with it is applied. A peeling body is configured to remove or peel a layer of peelable ink. The peeling body may be made of rubber (synthetic or natural), foam, felt, cloth, sponge, gum, silicone, etc.

A thermochromic ink is an ink that may change color as a function of the frictional heat to which it is subjected. A friction body is a body configured to be rubbed over a surface, for example in order to generate heat and thereby to cause a thermochromic ink to change color or being erased due to the heat generated by friction.

The friction body may be made of rubber or elastomer. For example, it may be made of SEBS (styrene-ethylene-butylene-styrene copolymer), SBS (styrene-butadiene-styrene copolymer), EPDM (ethylene-propylene-diene monomer) or any other rubber or elastomer having a high coefficient of friction, e.g. a friction coefficient ranging from 0.2 to 1.0 when rubbed against a paper surface, in particular a coefficient of friction ranging from 0.4 to 0.8 when rubbed against a paper surface or more generically defined a coefficient of friction of above 0.4 when rubbed against a paper surface.

Such erasable ink writing instruments may form a user friendly writing instruments wherein the eraser is prevented from being touched by the user while the writing tip may be easily protected when not used.

BRIEF DESCRIPTION OF THE DRAWINGS

Additional details and features of the disclosure are described with reference to the following figures in which.

DETAILED DESCRIPTION

Figure 1:
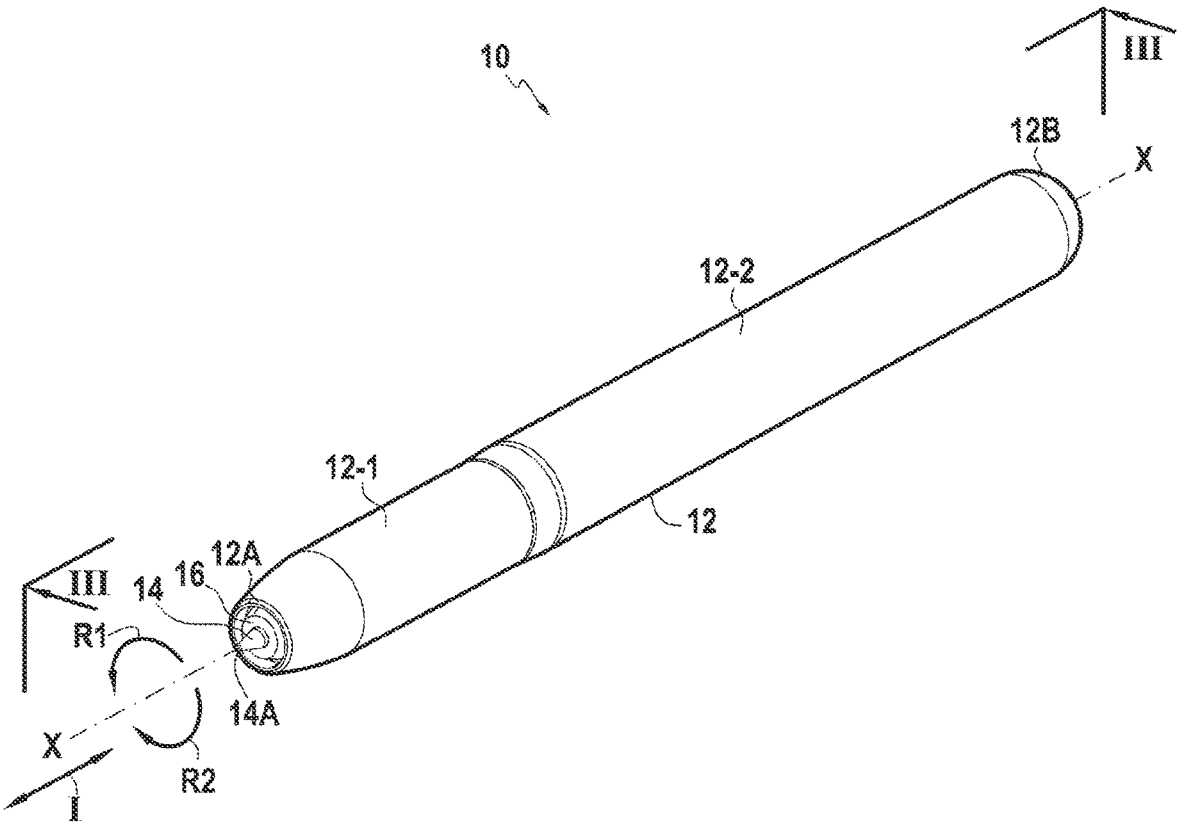
FIG. 1 shows an erasable ink writing instrument.
Figure 2:
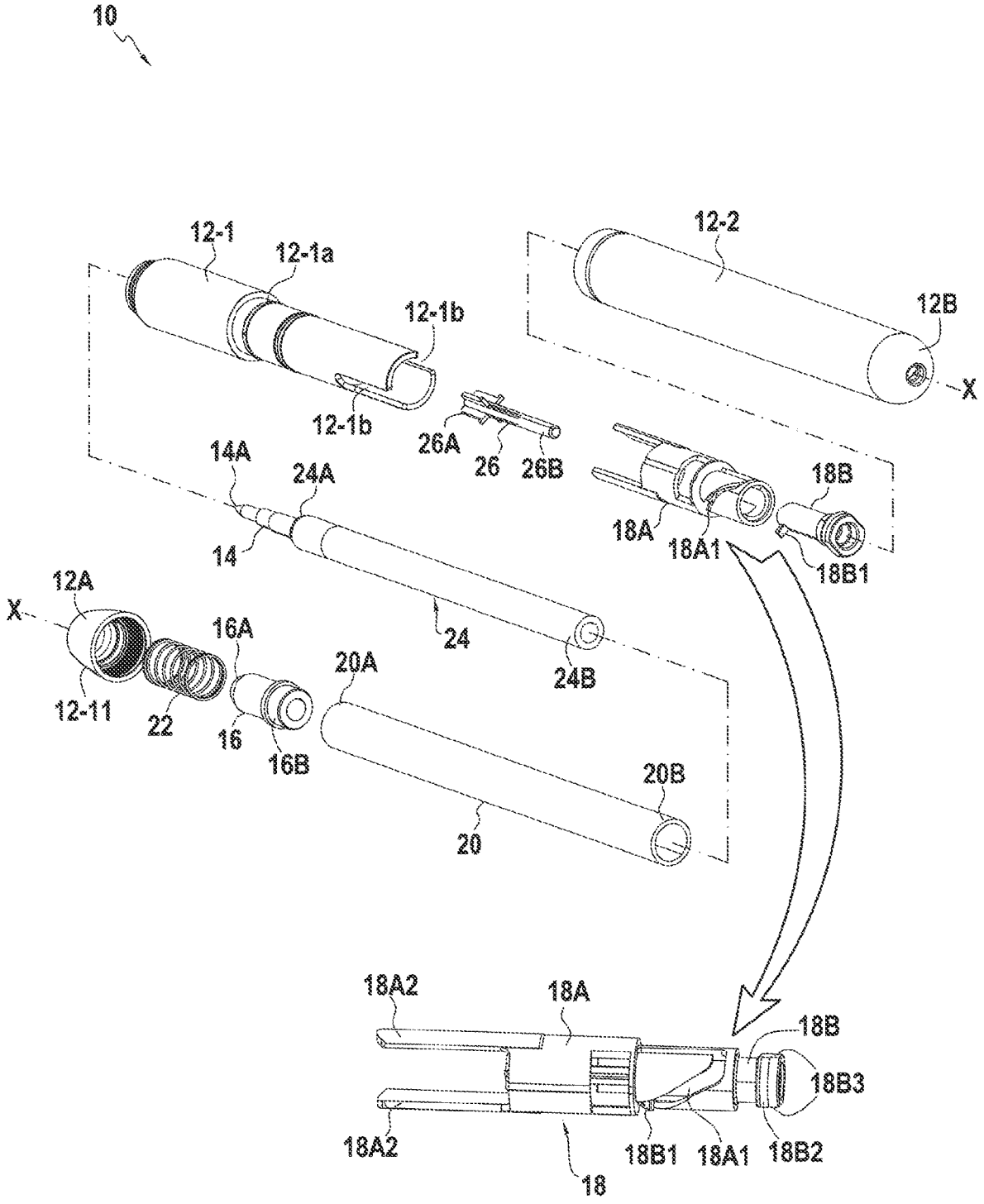
FIG. 2 shows an exploded view of the erasable ink writing instrument of FIG. 1.
Figure 3:
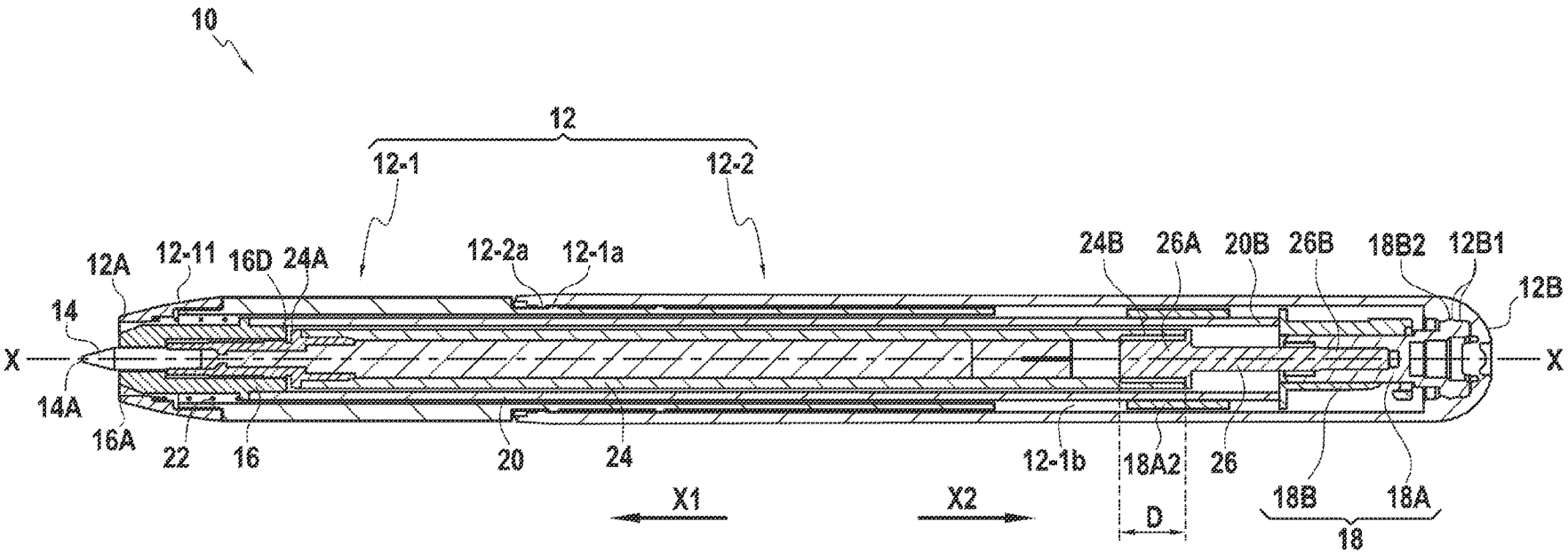
FIG. 3 shows a sectional view of the erasable ink writing instrument of FIG. 1, in the plane III of FIG. 1.

FIGS. 1, 2 and 3 show an erasable ink writing instrument 10 comprising a body 12 extending along an axis X. The body 12 has a first end (or front end) 12A and a second end (or rear end) 12B opposed to the first end 12A along the axis X. The first end 12A is provided with a writing tip 14 and with an eraser 16. The writing tip 14 is fed with erasable ink. The writing tip 14 is fixed with regard to the body 12. The eraser 16 is movable along the axis X with regard to the body 12 (see double-arrow I in FIG. 1). The erasable ink writing instrument 10 further comprises a helical-cam propelling mechanism 18 (see FIGS. 2 and 3) configured to move the eraser 16 along the axis X between a retracted position (see FIGS. 1, 3 and 4) and a protruding position (see FIG. 5).

The eraser 16 and the writing tip 14 may be coaxial. The eraser 16 may be disposed around the writing tip 14. The eraser 16 may form a sleeve extending along the axis X and configured to receive therein all or part of the writing tip 14. The writing tip 14 may comprise a writing end 14A. When the writing instrument 10 is seen perpendicular to the axis X as in FIGS. 4 to 6, the writing end 14A may be concealed by the eraser 16 when the eraser 16 is in the protruding position (see FIG. 6) and the writing end 14A may free from the eraser 16 when the eraser 16 is in the retracted position (see FIG. 4). When the writing instrument 10 is seen perpendicular to the axis X, the writing end 14A may be free from the eraser 16 when the eraser 16 is in an intermediate position between the protruding position and the retracted position (see FIG. 5). The eraser 16 may have a distal end 16A. The distal end may have a frustoconical shape. This may render the writing easier when the eraser 16 is in the intermediate position.

eraser 16 may be mounted onto a tube holder 20. In this example, a rear portion 16B (i.e. a portion axially disposed on the side of the second end 12B) of the eraser 16 is press fitted within a front end 20A (i.e. an end axially disposed on the side of the first end 12A) of the tube holder 20.

The helical-cam propelling mechanism 18 may comprise a first part 18A having in this example a helical cam 18A1 and a second part 18B having a cam follower 18B1. In this example, the first part 18A may have a single helical cam 18A1 and the second part 18B may have a single cam follower 18B1. As shown in the detailed view of FIG. 2, the cam follower 18B1 is engaged with the cam helical cam 18A1. In the present example, the angular stoke of the helical-cam propelling mechanism 18 may be up to 90°.

The second part 18B may be fixed to the second end 12B, inside the body 12. In this example, the second part 18B may be snap-fitted to the second end 12B. The snap-fitted parts of the second part 18B and of the second end 12B may be configured to cooperate in form fitting manner in order to prevent relative rotation between the second part 18B and the second end 12B around the axis X. A snap-fitting rib 18B2 may be engaged with a snap-fitting groove 12B1 in order to axially couple the second part 18B and the second end 12B while a flat 18B3 of the second part 18B may cooperate in form fitting manner with a complementary flat (not shown) of the second end 12B in order to rotatably couple the second part 18B and the second end 12B around the axis X. In the present example, two flats 18B3 and two complementary flats may be provided. Any other shape may be provided.

The body 12 may comprise a first portion 12-1 having the first end 12A and a second portion 12-2 having the second end 12B. The first portion 12-1 and the second portion 12-2 may be rotatable relative to each other. The first portion 12-1 and the second portion 12-2 may be rotatably snap-fitted. For example, the first portion 12-1 may have a snap-fitting annular rib 12-1*a* rotatably engaged with a complementary snap-fitting annular rib 12-2*a* of the second portion 12-2.

The first part 18A may be rotatably coupled with the first portion 12-1 and axially movable with regard to the first portion 12-1. For example, the first part 18A may comprise two axial projections 18A2 and the first portion 12-1 may comprise two axial recesses 12-1*b*. The two axial projections 18A2 and the two axial recesses 12-1*b* may be slidably engaged with each other axially.

In this example, the first part 18A may be hollow and may receive a rear end 20B of the tube holder 20. The first part 18A may be axially coupled in only a first direction X1 with the eraser 16, via the tube holder 20. In other words, the first part 18A may axially move the eraser 16 only when the first part 18A is moved in a first axial direction X1. The tube holder 20 may axially abut against the first part 18A. In other words, in this example the eraser 16 may abut axially against the first part 18A via the tube holder 20. When the first part 18A is moved in a second axial direction X2, opposite to the first axial direction X1, the first part 18A may be not able to move the eraser 16.

Figure 4:
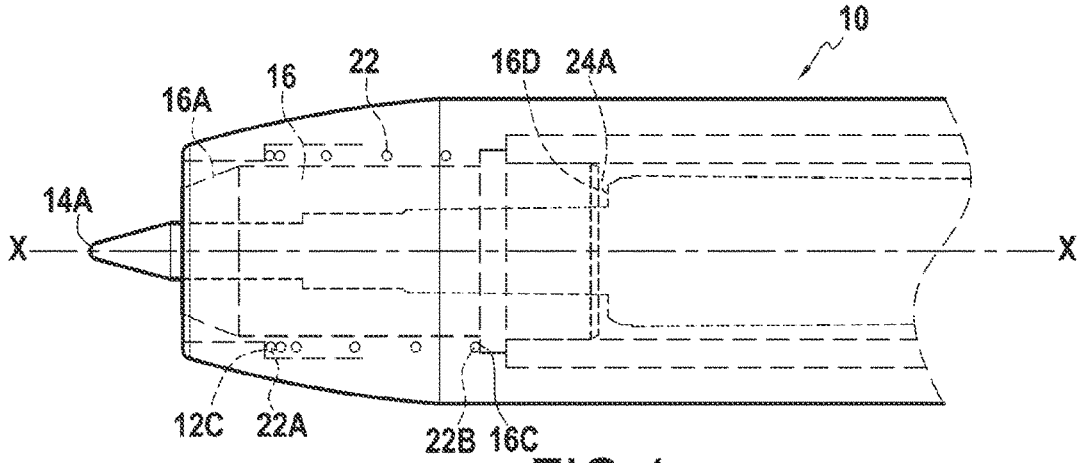
FIG. 4 shows the erasable ink writing instrument seen perpendicular to the axis X, the eraser being in the retracted position.
Figure 5:
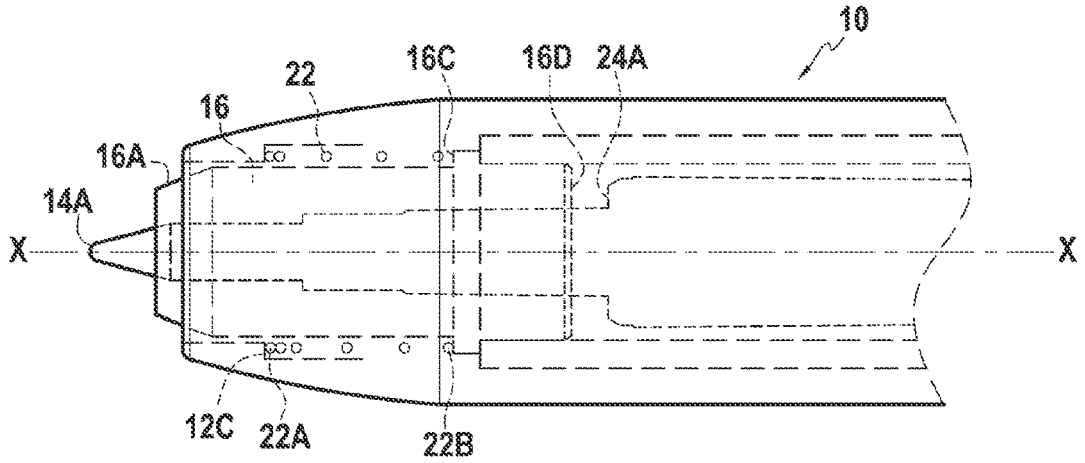
FIG. 5 shows the erasable ink writing instrument seen perpendicular to the axis X, the eraser being in an intermediate position between the retracted position and the protruding position.
Figure 6:
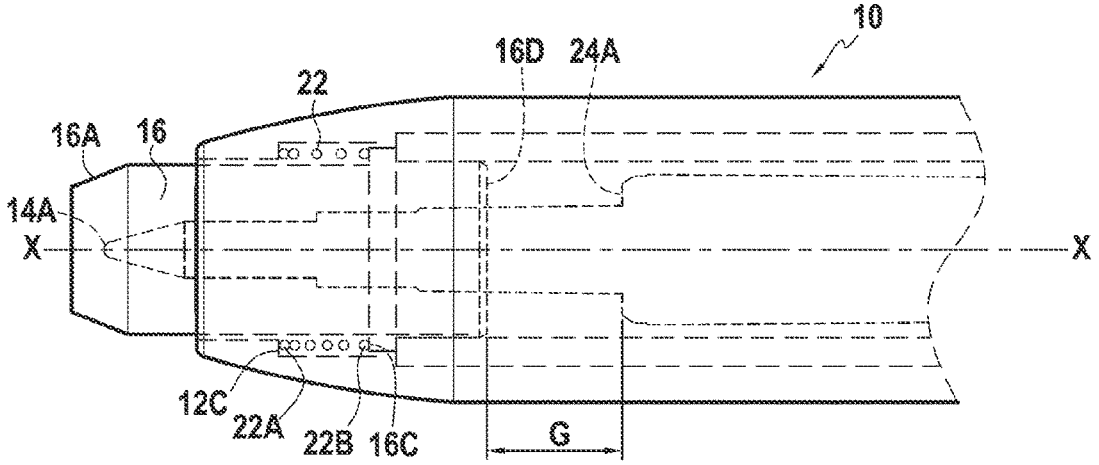
FIG. 6 shows the erasable ink writing instrument seen perpendicular to the axis X, the eraser being in the protruding position.

A return spring 22 may be configured to axially push the eraser 16 toward the first part 18A. In this example, the return spring 22 may be configured to axially push the eraser 16 from the extended position toward the retracted position, in the second axial direction X2. The return spring 22 may be a coil spring which works in compression. As shown in FIGS. 4 to 6, a first end 22A of the return spring 22 may abut against a first shoulder 12C of the body 12 and a second end 22B, axially opposite to the first end 22A, may abut against a shoulder 16C of the eraser 16. In a variant not shown, the second end 22B may abut against a shoulder of the tube holder 20.

Therefore, in the present example, when the second portion 12-2 of the body 12 is rotated relatively to the first portion 12-1 in the first rotational direction R1 around the axis X shown in FIG. 1, the second part 18B rotates together with the second portion 12-2 and pushes axially the first part 18A via the cam follower 18B1 and the helical cam 18A1 in the first axial direction X1, then pushing the eraser 16 in the first axial direction X1. The eraser 16 is thus moved from the retracted position (see FIG. 4) toward the intermediate and the protruding position (see FIGS. 5 and 6). No button may be needed in order to actuate the eraser 16. The writing instrument 10 may thus be a buttonless writing instrument. The structure of such a writing instrument may be simple and provide better ergonomics on the body.

When the second portion 12-2 of the body 12 is rotated relatively to the first portion 12-1 in the second rotational direction R2, opposite to the first rotational direction R1, as shown in FIG. 1, the second part 18B rotates together with the second portion 12-2 and pushes axially the first part 18A via the cam follower 18B1 and the helical cam 18A1 in the second axial direction X2. The return spring 22 then pushes simultaneously the eraser 16 in abutment, via the tube holder 20, against the first part 18A. The eraser 16 is thus moved from the protruding or intermediate position (see FIGS. 5 and 6) toward the retracted position (see FIG. 4).

In the present example, the writing instrument 10 may comprise a writing body 24, for example a cartridge, which may comprise the writing tip 14. The writing body 24 may also comprise an ink reservoir 25 configured to store erasable ink, for example thermochromic ink. The writing tip 14 may be fed with erasable ink by the reservoir 25. The eraser 16 may be a friction body.

The writing body 24 may extend at least in part into the tube holder 20 in any position of the eraser 16. The writing body 24 may be supported, in the tube holder 20 by a support 26.

The support 26 may extend inside the first part 18A and may be axially coupled with the second part 18B. The writing body 24 may be removable mounted to the support 26. For example, a rear end 24B of the writing body may be press fitted to a front portion 26A of the support 26. The support 26 may comprise a rear portion 26B, for example a rod, press fitted to the second part 18B. In an example not shown the support 26 and the second part 18B may be unitarily formed. The support 26 may stop the writing body 24 in the second axial direction X2.

The writing body 24 may have a front shoulder 24A which may abut against a complementary shoulder 16D of the eraser 16. Therefore, if the writing body 24 were to be detached from the support 26, writing body 24 may remain into the body 12. For example, a maximum axial gap G (see FIG. 6) between the front shoulder 24A and the complementary shoulder 16D may be less than a maximum axial stroke D (see FIG. 3) for removing the writing body 24 from the support 26 (or a maximum axial length of the front portion 26A engaged with the writing body 24). In such a case, there is no enough axial space between the two shoulders 24A and 16D for allowing the writing body 24 to be completely detached from the support 26. Therefore, the writing body 24 may remain attached to the support 26 in any configuration of the writing instrument 10.

As shown in FIGS. 4 to 6, the writing tip 14 is fixed with regard to the body 12 while the eraser 16 is movable between a retracted position (see FIG. 4) and a protruding position (see FIG. 6). When the eraser 16 is in the retracted position (see FIG. 4) or in the intermediate position (see FIG. 5) the eraser 16 may not be used and the writing tip 14 may be used for writing. When the eraser 16 is in the protruding position (see FIG. 6), the writing tip 14 is protected by the eraser 16 and may not be used and the eraser 16 may be used for erasing an erasable ink applied with the writing tip 14.

The body 12 may comprise a nose cone 12-11, the nose cone 12-11 comprising the first end 12A. The nose cone 12-11 may be part of the first portion 12-1. The nose cone 12-11 may be removable from the rest of the body 12. For example, the nose cone 12-11 may be screwed with the first portion 12-1. The nose cone 12-11 may be provided with the shoulder 12C against which the return spring 22 abuts. Thus, when removing the nose cone 12-11, the return spring 22 and the eraser 16 together with the tube holder 20 may be removed and the writing body 24 may be removed for refill.

Although the present disclosure is described with reference to specific examples, it is clear that modifications and changes may be made to these examples without going beyond the general scope of the disclosure. In particular, individual characteristics of the various embodiments shown and/or mentioned may be combined in additional embodiments. Consequently, the description and the drawings should be considered in a sense that is illustrative rather than restrictive.

Additionally, all of the disclosed features of an apparatus may be transposed, alone or in combination, to a method and vice versa.

The invention claimed is:

1. A thermochromic ink writing instrument comprising a body extending along an axis, the body having a first end and a second end opposed to the first end along the axis, the first end being provided with a writing tip and with an eraser, wherein the writing tip is fed with thermochromic ink, wherein the writing tip is fixed with regard to the body and the eraser is movable along the axis with regard to the body, and the thermochromic ink writing instrument further comprising a helical-cam propelling mechanism configured to move the eraser along the axis between a retracted position and a protruding position, wherein the helical-cam propelling mechanism includes a first part and a second part, the body comprises a first portion having the first end and a second portion having the second end, the first portion and the second portion are rotatable relative to each other, and the first part is rotatably coupled with the first portion and axially movable with regard to the first portion.

2. The thermochromic ink writing instrument according to claim 1, wherein the eraser and the writing tip are coaxial, the eraser being disposed around the writing tip, the writing tip comprising a writing end, and, when the thermochromic ink writing instrument is seen perpendicular to the axis, the writing end is concealed by the eraser when the eraser is in the protruding position and the writing end is free from the eraser when the eraser is in the retracted position.

3. The thermochromic ink writing instrument according to claim 1, wherein the first part includes one of a helical cam and a cam follower and the second part includes the other of the helical cam and the cam follower, and the first part is axially coupled in at least one direction with the eraser and the second part is fixed to the second end, inside the body.

4. The thermochromic ink writing instrument according to claim 1, wherein the second part is snap-fitted with the second end.

5. The thermochromic ink writing instrument according to claim 1, wherein the first part comprises one of at least one axial projection and at least one axial recess, the first portion comprises the other of the at least one axial projection and the at least one axial recess, and the at least one axial projection and the at least one axial recess are slidably engaged with each other axially.

6. The thermochromic ink writing instrument according to claim 1, comprising a writing body having the writing tip, wherein the eraser is mounted onto a tube holder, the eraser is axially coupled in at least one direction with the first part via the tube holder, and the writing body extends at least in part into the tube holder in any position of the eraser.

7. The thermochromic ink writing instrument according to claim 1, comprising a writing body having the writing tip, wherein the body comprises a nose cone, the nose cone comprises the first end, and the nose cone is removable, due to which the writing body is removable for refill.

8. The thermochromic ink writing instrument according to claim 1, wherein the eraser is mounted onto a tube holder, a rear portion of the eraser being configured to be fitted within a front end of the tube holder.

9. The thermochromic ink writing instrument according to claim 1, comprising a return spring configured to axially push the eraser toward the first part.

10. The thermochromic ink writing instrument according to claim 9, wherein the return spring is configured to axially push the eraser from the extended position toward the retracted position while the eraser abuts against the first part axially.

11. The thermochromic ink writing instrument according to claim 1, comprising a writing body having the writing tip, wherein the first part is hollow, a support extends inside the first part and is axially coupled with the second part, and the support supports the writing body.

12. The thermochromic ink writing instrument according to claim 11, wherein the writing body is removably mounted to the support.

13. The thermochromic ink writing instrument according to claim 11, wherein the writing body is press-fitted to the support.

14. The thermochromic ink writing instrument according to claim 11, wherein the support and the second part are unitarily formed.

15. The thermochromic ink writing instrument according to claim 1, wherein the eraser is a body configured to be rubbed over a surface to generate heat thereby causing the thermochromic ink to change color.

16. The thermochromic ink writing instrument according to claim 15, wherein the eraser is a friction body, and the eraser is made of rubber or elastomer.

17. The thermochromic ink writing instrument according to claim 15, wherein the eraser is made of styrene-ethylene-butylene-styrene copolymer (SEBS), styrene-butadiene-styrene copolymer (SBS), ethylene-propylene-diene monomer (EPDM).

18. The thermochromic ink writing instrument according to claim 15, wherein the eraser has a friction coefficient ranging from 0.2 to 1.0 when rubbed against a paper surface.

19. A thermochromic ink writing instrument comprising a body extending along an axis, the body having a first end and a second end opposed to the first end along the axis, the first end being provided with a writing tip and with an eraser, wherein the writing tip is fed with thermochromic ink, wherein the writing tip is fixed with regard to the body and the eraser is movable along the axis with regard to the body, and the thermochromic ink writing instrument further comprises a helical-cam propelling mechanism configured to move the eraser along the axis between a retracted position and a protruding position, wherein the helical-cam propelling mechanism includes a first part and a second part, and wherein the thermochromic ink writing instrument further comprises a return spring configured to axially push the eraser toward the first part.

20. A thermochromic ink writing instrument comprising a body extending along an axis, the body having a first end and a second end opposed to the first end along the axis, the first end being provided with a writing tip and with an eraser, wherein the writing tip is fed with thermochromic ink, wherein the writing tip is fixed with regard to the body and the eraser is movable along the axis with regard to the body, and the thermochromic ink writing instrument further comprises a helical-cam propelling mechanism configured to move the eraser along the axis between a retracted position and a protruding position, wherein the helical-cam propelling mechanism includes a first part and a second part, wherein the thermochromic ink writing instrument further comprises a writing body having the writing tip, wherein the first part is hollow, a support extends inside the first part and is axially coupled with the second part, and the support supports and restricts a movement of the writing body.

* * * * *